United States Patent [19]

Nimell

[11] 4,067,668

[45] Jan. 10, 1978

[54] VALVELESS ROTARY-OSCILLATING DOUBLE-ACTING PISTON PUMP

[75] Inventor: Erik Arne Nimell, Bromma, Sweden

[73] Assignee: Medical Products Octagon AB, Uppsala, Sweden

[21] Appl. No.: 710,082

[22] Filed: July 30, 1976

[30] Foreign Application Priority Data

July 31, 1975 Sweden ..... 7508708

[51] Int. Cl.[2] ..... F04B 7/06; F04B 39/10

[52] U.S. Cl. ..... 417/492; 417/500; 418/68

[58] Field of Search ..... 417/492, 500; 123/45 R, 123/45 A; 91/233; 418/68

[56] References Cited

U.S. PATENT DOCUMENTS

| | | | |
|---|---|---|---|
| 1,287,844 | 12/1918 | Bey | 417/492 |
| 2,316,107 | 4/1943 | Ruben | 123/45 A |
| 3,266,432 | 8/1966 | Wortley | 417/492 |

FOREIGN PATENT DOCUMENTS

| | | | |
|---|---|---|---|
| 690,836 | 9/1930 | France | 418/68 |
| 1,936,358 | 2/1971 | Germany | 417/500 |

*Primary Examiner*—Carlton R. Croyle
*Assistant Examiner*—Thomas I. Ross
*Attorney, Agent, or Firm*—Fred Philpitt

[57] ABSTRACT

In a pump comprising a first member provided with a circularly cylindrical cavity in which cavity a circularly cylindrical piston-like second member is arranged with rotating fit, the end surfaces of said second member being inclined to the axis of said member and said second member being provided with two substantially segment-shaped recesses arranged substantially opposite each other, which recesses are connected to one surface each of the two end surfaces of the second member by a channel or duct extending substantially in axial direction, and said second member being rotated with some axially reciprocating movement caused by cooperation of the inclined end surfaces with inclined surfaces in said first member resulting in the transfer of a fluid from an inlet conduit to an outlet conduit arranged substantially on diametrically opposite sides of said first member and connected with the cavity via said recesses and channels or ducts, the improvement which comprises that the two end surfaces of the piston-like second member are convexly vaulted with parallel or coincident center normal for the curvature and that the inclined surfaces of the first member are convexly vaulted with at least substantially the same radius of curvature as that of said end surfaces.

6 Claims, 8 Drawing Figures

Fig. 1
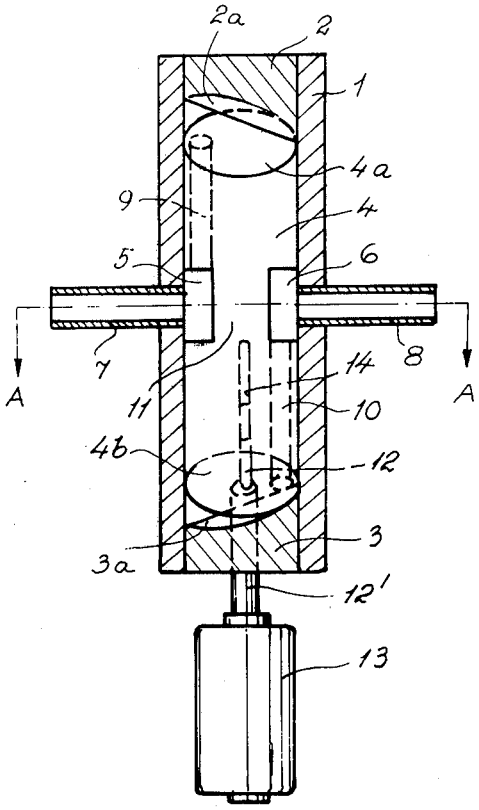
Fig. 2
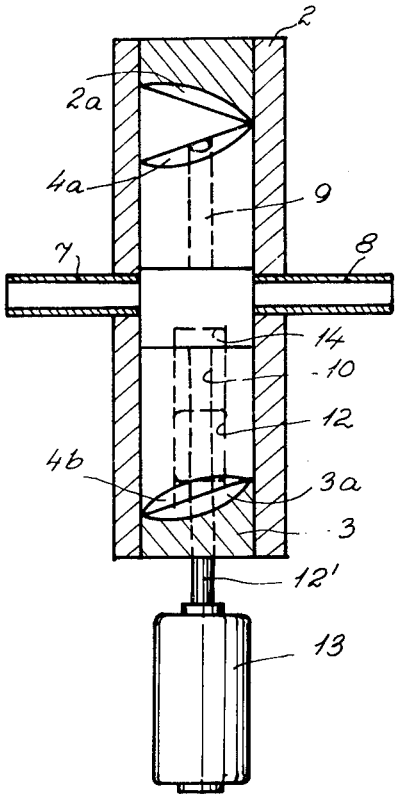
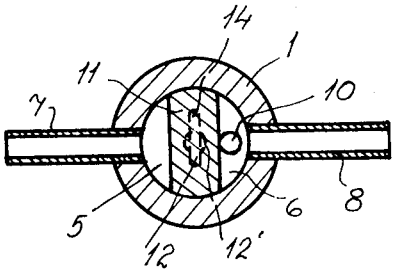
Fig. 1a
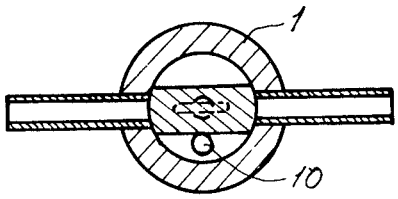
Fig 2a

Fig. 3
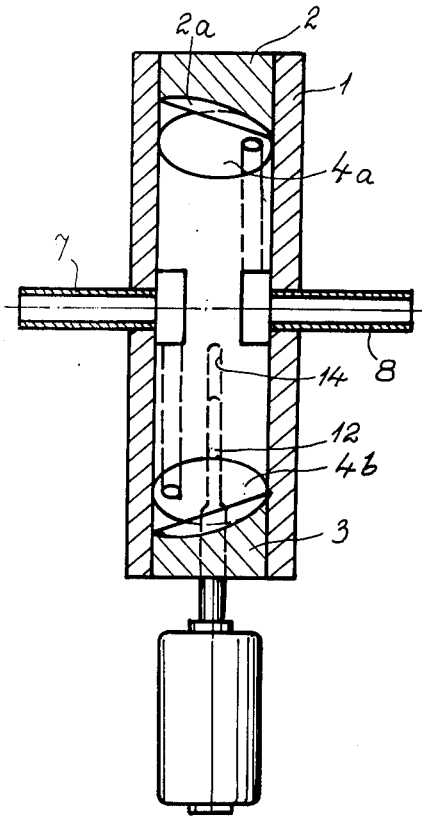
Fig. 4
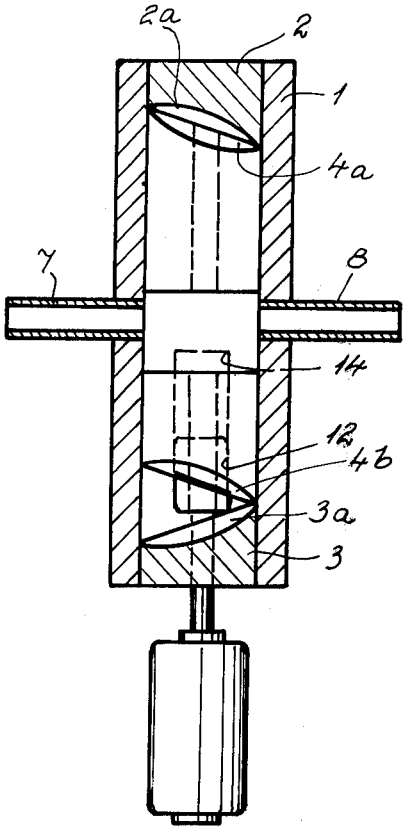
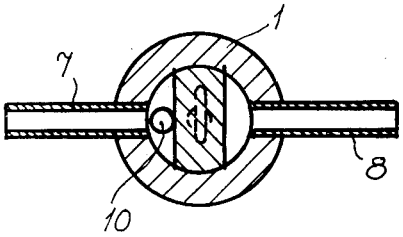
Fig. 3a
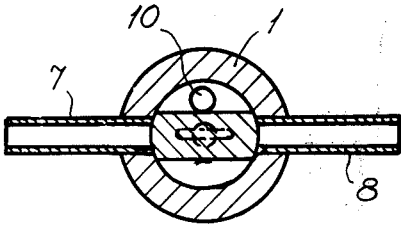
Fig. 4a

VALVELESS ROTARY-OSCILLATING DOUBLE-ACTING PISTON PUMP

The present invention relates to a pump with which a fluid such as a gas, vapour or liquid on operation by compulsion is transferred from an inlet conduit to an outlet conduit connected to the pump. The pump is primarily intended to be used for liquids in small quantities and since it can be constructed to deliver an accurately defined amount of fluid for each pump cycle it is especially suited for calibration and dosing purposes, e.g., in rainfall measurements. It may, however, advantageously also be used for several other purposes, e.g., in the compressor of a refrigerating machine or as an injection pump.

A plurality of different types of pumps has previously been constructed wherein a liquid by means of reciprocating piston and valves incident thereto or by means of rotating bodies of the gear wheel type or of the so-called impeller type by compulsion is transported in a pipe. For the above mentioned purposes the types hitherto known have exhibited too great a back leakage of the liquid and also other difficulties in the exact determination of the amount of the liquid transported by the pump to be contemplated when a greater accuracy is required in the determination of the amount of transported liquid. Furthermore, these known pumps often have a comparatively complicated and expensive construction and generally they have comparatively great energy requirements.

The present invention relates to a pump of a type which comprises a first member provided with a circularly cylindrical cavity in which cavity a circularly cylindrical piston-like second member is arranged with rotating fit, the end surfaces of said second member being inclined to the axis of said member and said second member being provided with two substantially segment-shaped recesses arranged substantially opposite each other, which recesses are connected to one surface each of the two end surfaces of the second member by a channel or duct extending substantially in axial direction, and said second member being rotated with some axially reciprocating movement caused by cooperation of the inclined end surfaces with inclined surfaces in said first member resulting in the transfer of a fluid from an inlet conduit to an outlet conduit arranged substantially on diametrically opposite sides of said first member and connected with the cavity via said recesses and channels or ducts. In order that the piston-like member should be given the axially reciprocating movement, the inclined surfaces of said first member are arranged to diverge from a smallest distance from each other slightly greater than the length between the inclined end surfaces of the second member, said end surfaces being substantially parallel to each other. The angle of the inclination of all inclined surfaces to the axial direction is substantially one and the same angle.

A pump of the above mentioned type is disclosed e.g. by U.S. Pat. No. 1,276,615. The inclined surfaces occurring in this known pump are plane and annular. The annular shape leads to the disadvantage that the pump works with a great dead space giving a bad accuracy. The plane surfaces also lead to g reat risks for locking of the piston in the end position. In order to try to overcome last mentioned disadvantage it has been suggested (see U.S. Pat. No. 1,287,844) to replace the inclined surfaces arranged rigidly in the first member by plane surfaces belonging to inclined annular plates which are resiliently supported in the cavity of the first member. By this construction the piston-like body will operate with a certain play. In addition to certain risks for locking of the piston which still remain the play will lead to increased wear and tear and elevated sound level on operation of the pump and also to a further impairment of the accuracy caused by a variation of the length of stroke of the piston-like member with varying number of revolutions as a result of the play.

According to the present invention there is provided a pump by means of which the above mentioned disadvantages are eliminated or reduced to an essential degree.

The pump according to the invention is characterized in that the two end surfaces of the piston-like second member are convexly vaulted with parallel or coincident center normal for the curvature and that the inclined surfaces of the first member are convexly vaulted with at least substantially the same radius of curvature as that of said end surfaces.

According to a preferred embodiment of the invention the curvature is adapted to the degree of inclination chosen for the inclined surfaces by decreasing the radius of curvature with increasing inclination in order to minimize friction and axial play between the inclined surfaces and also to minimize the dead space in the circularly cylindrical cavity. The degree of inclination is chosen going out from the desired length of stroke of the piston-like member, i.e., from the desired volume of fluid per cycle of work. The preferred radius for a certain inclination may, e.g., be established by experiments.

According to a particularly preferred embodiment of the invention the inclined surfaces of the piston-like member have a substantially cylindrically convex shape, i.e. the surfaces are curved with coincident center normals.

Rotation of the piston-like member may be achieved by an externally driven axle which is arranged axially and the end of which is introduced into a space in said member and is axially slidably but not turnably arranged therein, so that the piston-like member can perform axially reciprocating movements during its rotation. According to another embodiment the pump according to the invention also comprises means for rotation of the piston-like member by induction means, e.g. electromagnetically.

In order to further elucidate the construction and operation of a pump according to the invention reference is made to the accompanying drawings wherein FIG. 1 – 4 schematically show four longitudinal sections through an embodiment of the pump according to the invention in four different phases of the pump sequence and FIGS. 1*a* – 4*a* show in cross-section through the center of the pump along line A-A in FIGS. 1 – 4 the corresponding phase position of the movable part of the pump, namely the central piston-like angle cut body, which will be described more in detail below.

The drawings show the pump housing which comprises a tubular cylinder 1 which is proviced with closures 2 and 3 in both ends to form an enclosed space. The closures 2 and 3 present inwardly inclined 2*a* and 3*a* which are converging against each other and are slightly convex. About in level with the center of the space an inlet conduit and an outlet conduit 7 and 8 are connected at diametrically opposed wall sections of the cylindrical tube 1. The two surfaces 2*a* and 3*a* converging against each other also converge against one of the connected conduits 7 and 8.

The movable part of the fluid pump is placed in the enclosed space and comprises the circularly cylindrical piston-like member 4, which is provided with inclined mutually parallel end surfaces 4*a* and 4*b* which have the same angle of inclination to the central axis as the inclined surfaces 2*a* and 3*a*. These surfaces 4*a* and 4*b* have a slightly convex shape. The intermediate part of the member 4 is provided with two segment shaped recesses 5 and 6 positioned opposite to each other to the formation of a waist 11 between said recesses 5 and 6 said waist 11 being defined laterally by two opposite parts of the cylinder surface of the member 4 on one hand and by two plane mutually parallel surfaces on the other, which surfaces are at a mutual distance somewhat greater than the internal diameter of the inlet and outlet conduits 7 and 8. A boring or channel 9 extends in the piston-like member 4 between the recess 5 and the end surface 4*a* and a similar channel 10 extends in the piston-like member 4 between the recess 6 and the end surface 4*b*. The member 4 has good fit laterally and may be caused to rotate on its axis in the cavity. By adjustment of the space between the surfaces 2*a* and 3*a* to the distance between the surfaces 4*a* and 4*b* of the member 4 and by shaping of these surfaces in a suitable way the member 4 is given an axially reciprocating movement at its rotation with a practically play-free guidance by the inclined surfaces, which surfaces in every position of the member 4 make contact in pairs with each other substantially at the periphery except for the turn positions where a one-dimensional contact may be obtained in a preferred embodiment of the contact surfaces. No surface contact must occur in these turn positions because a mutual locking would occur in such a case. For a certain shaping of one of the pairs of inclined surfaces, e.g., those of the rotating member, it is possible by a number of methods to construct the shape of the corresponding surfaces of the rigid member which shape as closely as possible without mutual locking concurs with its rotating partner and in such a way that practically no play arises, i.e., the two pairs of surfaces are in all positions in contact with each other. The methods which are or may be contemplated to be used are similar to those used in the calculation and construction of, for instance, gear teeth. In practice the need for some tolerance and adjustments in order to obtain low wear and tear and smooth running, for instance some rounding off of the edges of the inclined surfaces, is to be added.

The rotating member 4 is rotated by an axle 12 driven by a motor 13 and inserted into a channel 14 in the member 4.

In FIGS. 1–4 and corresponding FIGS. 1*a* –4*a* the rotating member is shown in four different phase positions during the pump sequence. In FIG. 1 and FIG. 1*a* the intermediate section 11 is positioned at right angles to the connection conduits 7 and 8. Presume that the member 4 is rotating clock-wise when seen from above. In that case the lower space between the surfaces 3*a* and 4*b* will decrease and the upper space between the surfaces 2*a* and 4*a* will increase to the effect that the fluid to be pumped is forced from the lower space through the channel 10 to the outlet conduit 8 and that fluid is sucked from the inlet conduit 7 through the channel 9 to the upper space. In FIG. 2 and FIG. 2*a* there is shown the lower turn position where the upper space has its greatest volume and the lower space its samllest volume and a linear contact between the surfaces 3*a* and 4*b* may occur. The communication with the inlet and outlet conduits is blocked in this position by the intermediate section 11. When the piston 4 now continues its rotation the upper space begins decreasing, fluid being forced through the channel 9 which is now in communication with the outlet conduit 8. The lower space on the other hand is now increasing and fluid is sucked thereinto through the channel 10 from the inlet conduit 7. This is shown in FIG. 3 and FIG. 3*a*. In FIG. 4 and FIG. 4*a*, finally, the piston has reached its upper turn position wherein the lower space is of maximum size and the upper space of minimum size. The pump cycle is then repeated to the effect that fluid is continuously transported from inlet to outlet. It is easily seen that the transport direction is changed with the direction of rotation.

It is easily understood that the pump capacity is varied with the diameter of the piston, the speed of rotation and the angle of inclination of the guiding surfaces. The way in which the piston is caused to rotate may be varied. One way is to introduce a driving axle from one end of the pump body so that the end of the driving axle is axially transposable in the piston but not turnably in relation thereto. Driving by means of inductivity may also be considered advantageous.

As to the materials which may be contemplated when constructing the active parts of the piston and the pump body of the pump made according to the invention stainless steel, bronze, bearing bronze, light metal, Delrin (trade mark) and other suitable artificial materials may be mentioned. The surrounding parts may be made of essentially the same materials.

In view of the fact that a pump according to the invention can give a comparatively high pressure to the jet of fluid it can be used for the purpose of rinsing the system clean before the calibration. The pump is also in this respect completely superior to constructions previously used, especially with respect to the consumption of energy.

What is claimed is:

1. A pump which comprises a first member provided with a circularly cylindrical cavity in which cavity a circularly cylindrical piston-like second member is arranged with rotating fit, the end surfaces of said second member being inclined to the axis of said second member and said second member being provided with two substantially segment-shaped recesses arranged substantially opposite each other, which recesses are connected to one surface each of the two end surfaces of the second member by a channel or duct extending substantially in the axial direction, and said first member having closure portions with inclined surfaces, and means to rotate said second member with some axially reciprocating movement caused by cooperation of the inclined end surfaces with the inclined surfaces in said first member resulting in the transfer of a fluid from an inlet conduit to an outlet conduit arranged substantially on diametrically opposite sides of said first member and connected with the cavity via said recesses and channels or ducts, which pump is characterized in that the two end surfaces of the piston-like second member are convexly vaulted with parallel or coincident center normals for the curvature and that the inclined surfaces of the first member are convexly vaulted with at least substantially the same radius of curvature as that of said end surfaces.

2. A pump according to claim 1, wherein the curvature is adapted to the degree of inclination chosen for the inclined surfaces by decreasing the radius of curvature with increasing inclination in order to minimize friction and axial play between the inclined surfaces and also to minimize the dead space in the circularly cylindrical cavity.

3. A pump according to claim 1, wherein the inclined surfaces of the piston-like member have a substantially cylindrically convex shape.

4. A pump according to claim 1, wherein rotation of the piston-like member is achieved by an externally driven axle which is arranged axially and the end of which is introduced into a space in said member and is axially slidably but not turnably arranged therein, so that the piston-like member can perform axially reciprocating movements during its rotation with in axial respect stationary axle.

5. A pump according to claim 1 in which the means for rotation of the piston-like member comprises induction means.

6. A pump according to claim 5 wherein said means for rotation of the piston-like member is an electromagnetic means.

* * * * *